United States Patent [19]

Nakamura

[11] Patent Number: 4,672,772

[45] Date of Patent: Jun. 16, 1987

[54] BALANCED DOOR FOR AIRPLANE LAVATORIES AND THE LIKE

[76] Inventor: Ichiro Nakamura, 5900 119th Ave. SE., Bellevue, Wash. 98006

[21] Appl. No.: 909,771

[22] Filed: Sep. 19, 1986

[51] Int. Cl.[4] ..... E05D 15/28

[52] U.S. Cl. ..... 49/253; 49/334

[58] Field of Search ..... 49/253, 153, 333, 334

[56] References Cited

U.S. PATENT DOCUMENTS

| | | | |
|---|---|---|---|
| 1,010,071 | 10/1911 | Potter | 16/72 |
| 2,019,527 | 11/1935 | Ellison | 49/252 |
| 2,059,143 | 10/1936 | Renwick | 49/252 |
| 2,230,783 | 2/1941 | Parsons et al. | 49/334 X |
| 2,584,404 | 2/1952 | Webb | 110/173 R |
| 2,768,409 | 12/1956 | Lutter | 49/52 |
| 2,856,181 | 10/1958 | Fenton | 49/253 |
| 3,142,095 | 7/1964 | Sawyer | 49/366 |
| 3,605,339 | 9/1971 | Catlett et al. | 49/340 |
| 4,086,726 | 5/1978 | Moses | 49/37 |
| 4,118,016 | 10/1978 | Westeren et al. | 49/253 X |
| 4,251,900 | 2/1981 | Lautenschläger | 16/294 |
| 4,286,411 | 9/1981 | Wikkerink et al. | 49/252 |

*Primary Examiner*—Kenneth Downey
*Attorney, Agent, or Firm*—John O. Graybeal

[57] ABSTRACT

A balanced door operating mechanism comprising a floor sheave, a door sheave, an arm extending between the wheels, and a cable rotatably coupling the wheels. The floor sheave is fastened substantially adjacent a side jamb of the door frame between the threshold and the door, and is oriented with the axis of rotation thereof parallel to the axis of rotation of the door. The door sheave is fastened to the door coplanar with the floor sheave so that the axis of rotation of the door sheave is inset medially from and oriented parallel to the axis of the floor sheave. The substantially rigid arm is pivotably mounted at a proximal end on the floor sheave, and at a distal end on the door sheave, and carries at least part of the weight of the door. The cable frictionally engages peripheral grooves in the floor sheave and the door sheave, and extends between peripheral points of the sheaves which are closer to one face of the door than to the other. A coil type spring biases the door toward a normally closed position.

13 Claims, 5 Drawing Figures

BALANCED DOOR FOR AIRPLANE LAVATORIES AND THE LIKE

BACKGROUND OF THE INVENTION

1. Technical Field

This invention relates to balanced doors which pivot around medially inset vertical axes. More particularly, this invention relates to an operating mechanism for a balanced door which moves the door in a balanced manner without requiring a separate guide track along the door frame and interfitting guide roller on the door. The balanced door of the present invention is particularly suited for use as the door of an aircraft lavatory or the like.

2. Description of the Prior Art

Balanced doors are characterized by the balance between that part of the door which swings inwardly from the door frame and that part of the door which swings outwardly from the frame. Balanced doors are preferred where space limitations prevent the use of conventional doors pivoted on butt or other leaved hinges. Conventional doors require clearance for the full width of the door to swing inwardly or outwardly from the door frame.

A balanced door pivots around a medially inset axis so that one side portion of the door swings inwardly from the door frame while the other side portion of the door swings outwardly from the frame. Balanced doors are generally disclosed in Ellison U.S. Pat. No. 2,019,527, Lutter U.S. Pat. No. 2,768,409, Catlett et al. U.S. Pat. No. 3,605,339 and Wikkerink et al. U.S. Pat. No. 4,286,411. Until now, balanced movement of a door could be obtained only by providing a guide roller extending upwardly from the upper end of the door and engaging a downwardly opening guide track inset into or affixed to the header of the door frame. Such guide tracks and rollers necessarily complicate installation of the door. In some instances the door frame may not admit installation of the guide track, preventing use of a balanced door.

SUMMARY OF THE INVENTION

It is thus an object of the present invention to provide an operating mechanism for a balanced door which obviates the need for a guide track and interfitting roller.

It is another object of this invention to provide a balanced door operating mechanism which is readily installed on and removed from the door frame.

It is yet another object of this invention to provide a balanced door operating mechanism which includes means for biasing the door toward either an opened position or a closed position.

It is a further object of this invention to provide a balanced door operating mechanism which is self-contained and compact.

It is yet a further object of this invention to provide a balanced door operating mechanism the components of which are protected from outside damage.

These and other objects are provided by a balanced door operating mechanism for use with a door disposed within a door frame, the door frame having a side jamb substantially parallel to a selected axis of rotation of the door. The operating mechanism comprises a fixed wheel, a door wheel, an arm extending between the wheels, and coupling means rotatably coupling the wheels. The fixed wheel is fastenable to the door frame substantially adjacent the side jamb thereof so as to be oriented with the axis of rotation of said fixed wheel parallel to the desired axis of rotation of the door. The door wheel is fastenable to the door substantially coplanar with the fixed wheel so that the axis of rotation of said door wheel is spaced medially from and oriented parallel to the axis of the fixed wheel. The substantially rigid arm comprises a proximal end mounted so as to be pivotable around the axis of rotation of the fixed wheel, and a distal end mounted so as to be pivotable around the axis of rotation of the door wheel. The arm is capable of transferring at least part of the weight of the door to the door frame. The coupling means rotationally couples the door wheel and the fixed wheel such that a given amount of rotation of said door wheel in a selected direction around the axis thereof produces corresponding rotation of the distal end of the arm around the axis of said fixed wheel in the opposite direction and in an amount about ninety degrees (90°) less than the amount of rotation of said door wheel.

The door wheel is preferably a door sheave, and the fixed wheel is preferably a floor sheave fastenable to the threshold of the door frame and having an effective circumference about twice the effective circumference of the door sheave. The coupling means preferably comprises a substantially inextensible flexible member such as a cable or wire which frictionally engages and extends between peripheral portions of the floor sheave and the door sheave. The peripheral portions of the floor sheave and the door sheave are closer to one of the planar faces of the door than to the other such face. The operating mechanism also preferably includes means such as a coil type spring for biasing the door toward a normal position, for instance a normally closed position.

Other features and advantages of the present invention will become apparent from the following detailed description of a typical embodiment thereof, taken in conjunction with the accompanying drawings.

DESCRIPTION OF THE PREFERRED EMBODIMENT

Figure 1:
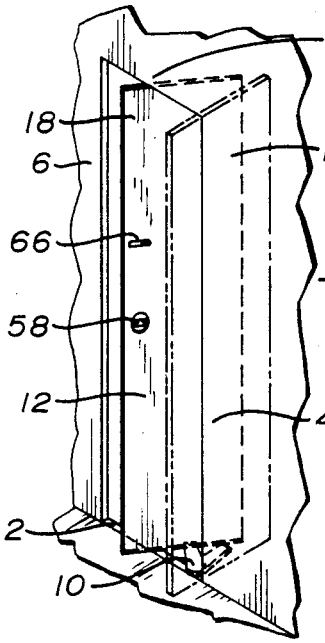
FIG. 1 is an isometric view of a balanced door and operating mechanism according to the present invention.

As seen in FIG. 1, the operating mechanism 10 of the present invention is used in conjunction with a door 12 disposed within a door frame. The door frame comprises a threshold 2, two side jambs 4,6 and a header 8 which together define an opening or doorway through a wall, partition or other vertical barrier between two spaces. The door 12 moves in a balanced fashion between a closed position and an opened position. When the door 12 is in the closed position, the vertical side edges of the door are positioned adjacent the side jambs 4,6 of the door frame so that the door substantially closes the doorway. In the opened position, the door 12 is substantially perpendicular to the wall and admits passage through the doorway.

As seen in the cross-sectional views of FIGS. 2–5, the operating mechanism 10 of the present invention carries the door 12 on an arm 14. The arm 14 is pivotably mounted adjacent a selected one of the side jambs of the door frame, which shall be referred to as the pivot jamb 4. The vertical side portion of the door 12 adjacent said pivot jamb 4 when the door is in the closed position shall be referred to as the pivot side 16 of the door. The opposite vertical side portion of the door 12 shall be referred to as the latch side 18 of the door, and the side jamb adjacent thereto when the door is in the closed posotion shall be referred to as the latch jamb 6. It will be understood that while the adjacent relationships between the pivot side 16 and the pivot jamb 4 and between the latch side 18 and the latch jamb 6 remain constant, the selection of the pivot and latch sides and jambs as being on a given side or end of the doorway are a matter of design choice.

The operating mechanism 10 comprises the arm 14, a floor sheave 20 fastened to the threshold 2, a door sheave 22 fastened to the lower end edge of the door 12 adjacent the threshold, and a wire or cable 24 extending between the floor sheave and the door sheave. It will thus be seen that a suitable gap must be provided between the threshold 2 and at least that portion of the lower end edge of the door 12 adjacent the operating mechanism 10.

Figure 5:
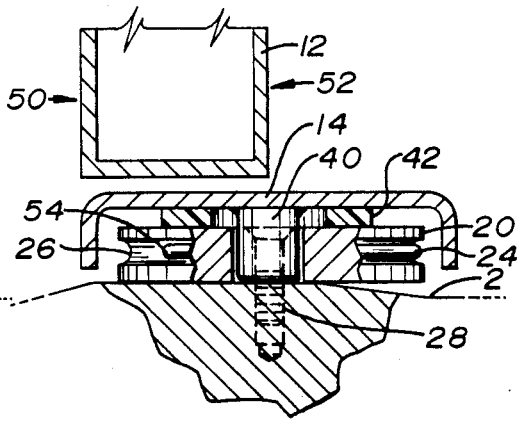
FIG. 5 is an end elevational cross-section through the floor sheave, taken along the line 5—5 of FIG. 3. 1-3.

As best seen in FIG. 5, the floor sheave 20 is preferably a substantially conventional wheel having an at least partially circumferential groove 26 for receiving the cable 24. The floor sheave 20 is oriented so that the axis of rotation thereof is parallel to the vertical edges of the door jambs 4,6 and the vertical side edges of the door 12. The threshold 2 is orthogonal to such vertical edges, and the floor sheave 20 is fastened with the underside thereof immediately adjacent the threshold. The floor sheave 20 is securely fastened to the threshold 2, as by conventional threaded screws 28 extending through said sheave into the threshold 2. The arm 14 is pivotably mounted to rotate around the vertical axis coaxial with the axis of rotation of the floor sheave 20. This axis shall be referred to as the fixed axis because of the fixed position of the floor sheave 20 defining said axis.

Figure 4:
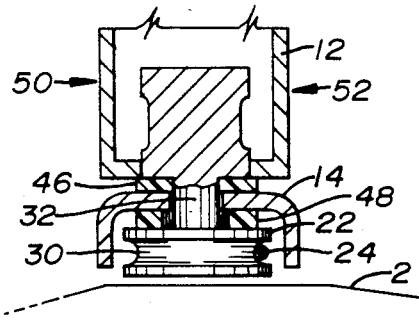
FIG. 4 is an end elevational cross-section through the door sheave, taken along the line 4—4 of FIG. 3.

As best seen in FIG. 4, the door sheave 22 is a substantially conventional wheel having an effective circumference about one-half the effective circumference of the floor sheave 20, and having an at least partially circumferential groove 30 for receiving the cable 24. The door sheave 22 is fixedly and coaxially mounted on a door sheave shaft 32 which is fixedly attached to the lower end edge of the door 12, so that the axis of rotation of the door sheave is parallel to the fixed axis through the floor sheave 20. The door sheave shaft 32 spaces the door sheave 22 downwardly from the lower end edge of the door 12 to provide a suitable gap between the upper planar surface of said sheave and the door, so that the circumferential groove 30 of the door sheave and the groove 26 of the floor sheave 20 are substantially coplanar. The door sheave 22 is inset medially from the vertical edge of the pivot side 16 of the door 12. The medial inset of the door sheave 22 is measured between the axis of rotation thereof and the vertical edge of the pivot side 14 of the door 12, and is most readily expressed as a fraction of the width of the door 12 between the vertical side edges thereof. The amount of the medial inset of the door sheave 22 determines the balance between the portion of the width of the door 12 which opens inwardly and that portion which opens outwardly, and thus is a matter of design choice. Where the door sheave 22 is inset medially by one-fourth the width of the door 12, the inwardly opening and outwardly opening portions of the door 12 are substantially equal. Where the door sheave 22 is inset medially by one-third the width of the door 12, the inwardly opening portion of the door 12 is about twice the width of the outwardly opening portion thereof. Where the door sheave 22 is inset medially by one-half the width of the door 12, placing the axis of the door sheave on the vertical centerline of the door, the door opens entirely inwardly.

Figure 3:
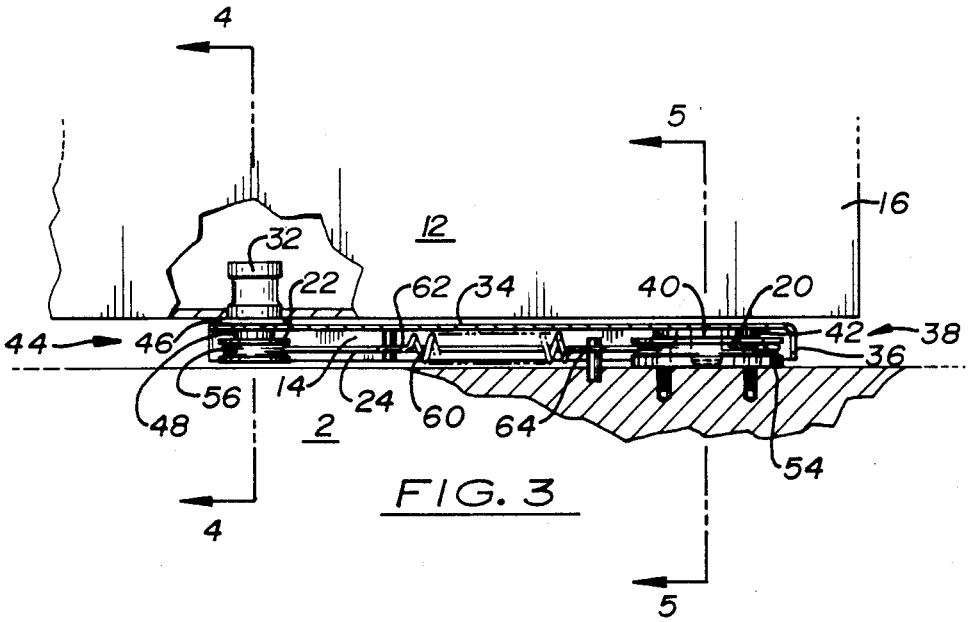
FIG. 3 is a side elevational cross-section through the door and operating mechanism, taken along the line 3—3 of FIG. 2.

The arm 14 essentially comprises a rigid member which extends between and spaces apart the floor sheave 20 and the door sheave 22, and thus ensures that the axis of the door sheave remains medially inset from the fixed axis of the floor sheave 20 as required for balanced movement of the door 12. The arm 14 preferably further covers the floor sheave 20, door sheave 22 and cable 24 to protect such components from damage and to provide an integral compact unobtrusive operating mechanism beneath the door 12. As best seen in FIG. 3, the arm 14 comprises a flat rigid arm plate 34 and a peripheral side wall 36. The arm plate 34 is oriented parallel to the planar surfaces of the floor sheave 20 and door sheave 22, and thus substantially parallel to the threshold 2 of the door frame. A proximal end 38 of the arm 14 is pivotably mounted around the fixed axis of the floor sheave 20 by means of an arm shaft 40 rotatably disposed within the floor sheave. The cylindrical arm shaft 40 is affixed at one end to the underside of the arm plate 34 at the proximal end 38 of the arm 14, and depends therefrom into a central aperture of the floor sheave 20. An annular low friction washer 42 disposed around the arm shaft 40 between the floor sheave 20 and the arm plate 34 further supports the arm 14 upon the floor sheave. The arm shaft 40 thus pivotably mounts the proximal end 38 of the arm 14 on the floor sheave 20 so that the arm is rotatable around the fixed axis of said sheave.

The arm 14 extends from its proximal end 38 to a distal end 44 supporting the door 12 and the door sheave 22 above the threshold 2. The arm plate 34 at the distal end 44 of the arm 14 is disposed in the gap between the door 12 and the door sheave 22, with the door sheave shaft 32 extending through a circular aperture in the arm plate. Annular low friction washers 46,48 are disposed around the door sheave shaft 32 between the door 12 and the arm plate 34 and between the arm plate and the door sheave 22. The door 12 and the door sheave 22 are thus rotatable around the axis of the door sheave within the central aperture of the arm plate 34.

The side wall 36 of the arm 14 protects the components of the operating mechanism 10 from damage and provides a compact integral operating mechanism for the door 12. The side wall 36 is fixedly attached around the periphery of the arm plate 34, and depends therefrom a distance at least sufficient to cover the cable 24 from view, but not so great as to catch on the threshold 2. The width of the arm plate 34 is greater at the proximal end 38 of the arm adjacent the larger floor sheave 20 than at the distal end 44 adjacent the smaller door sheave 22 in order to provide a consistent measure of clearance between the dependent peripheral side wall 36 and the sheaves 20,22 and cable 24.

The operating mechanism 10 of the present invention precisely and smoothly moves the door 12 in a balanced manner by operably coupling two sheaves having a carefully determined ratio of effective circumferences, thereby obviating the guide track and roller assemblies which characterize prior art balanced doors. The cable 24 is best described with reference to the two vertical planar faces of the door 12, which shall be referred to as the outer face 50 and the inner face 52. The outer face 50 of the door 12 is that face which must initially be pulled to open the door from the closed position, and which is positioned substantially adjacent the pivot jamb 4 when the door is in the opened position. The inner face 52 of the door 12 is that face opposite the outer face 50 which must initially be pulled to close the door.

The cable 24 extends between and engages the respective circumferential grooves 26,30 of the floor sheave 20 and the door sheave 22, coupling the rotation of the door sheave around the vertical axis therethrough to rotation of the arm 14 around the fixed axis of the floor sheave. The cable 24 is a flexible, substantially inextensible segment fastened at a first end 54 to the floor sheave 20 and at an opposite second end 56 to the door sheave 22, and frictionally engaging the respective grooves 26,30 of said sheaves. The cable 24 spans between tangents to the grooves 26,30 which are located closer to the inner face 52 of the door 12 than to the outer face 50 thereof. In other words, the cable 24 extends between the floor sheave 20 and the door sheave 22 substantially below the inner face 52 of the door 12.

Figure 2:
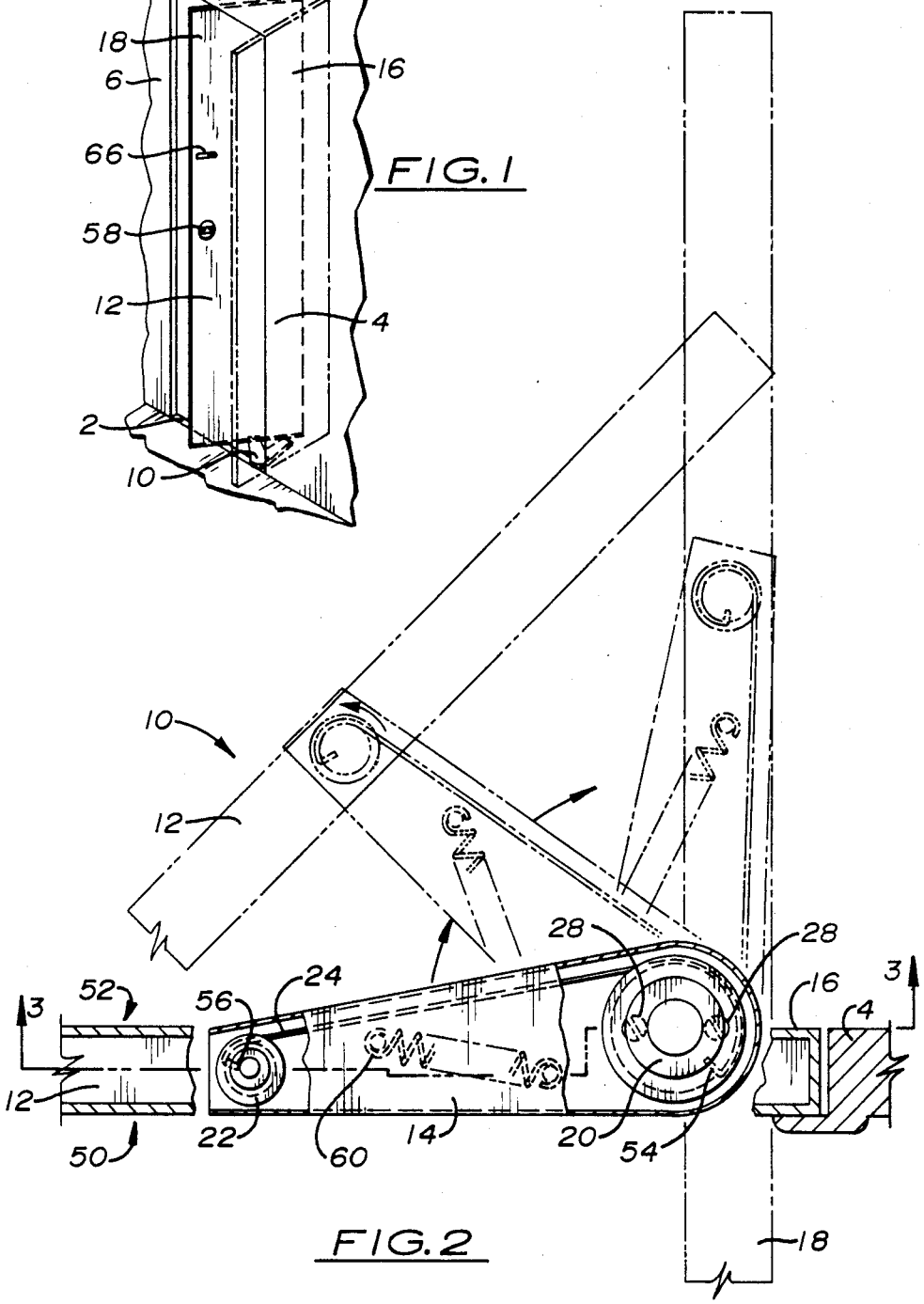
FIG. 2 is a plan cross-section through the door and operating mechanism of FIG. 1 in a closed position, with partially and fully opened positions thereof shown in broken lines, and with portions of the arm broken away to better show the components of the operating mechanism.

When the door 12 is in the closed position as shown in solid lines in FIG. 2, the arm 14 extends from the pivot jamb 4 toward the latch jamb 6 substantially parallel to the door. The door 12 is opened by pulling on the outer face 50 of the latch side 18 of the door, preferably by means of a handle 58, thereby moving the latch side of the door outwardly from the door frame. Such movement of the latch side 18 of the door causes the door 12 to rotate around the vertical axis of the door sheave 22 at the distal end 44 of the arm 14, rotating the door sheave. Such rotation of the door sheave 22 initially tensions the cable 24 extending between the door sheave and the floor sheave 20. Because the first end 54 of the cable 24 is tangent to the groove 26 of the floor sheave 20 at a point inwardly of the fixed axis through the floor sheave, increasing the tension in the cable 24 by pulling on the handle 58 produces a moment around the fixed axis tending to rotate the arm 14 so that the distal end 44 thereof swings inwardly, carrying the door sheave 22 and the pivot side 16 of the door 12 inwardly. Continued pulling on the handle 58 results in continuing outward movement of the latch side 18 of the door 12 and continuing inward movement of the distal end 44 of the arm 14 and the pivot side 16 of the door, i.e. in balanced movement of the door toward the opened position.

Balanced movement of the door 12 requires that the ratio of the effective circumference of the floor sheave 20 to the effective circumference of the door sheave 22 be about 2:1. This 2:1 ratio ensures that as the door 12 swings open in response to pulling of the handle 58, the door simultaneously rotates so that when the door is fully opened the outer face 50 thereof rests adjacent the pivot jamb 4 substantially perpendicular to the plane of the doorway, with the pivot side 16 of the door located inwardly of the door frame and the latch side 18 of the door located outwardly of the door frame. Referring to FIG. 2, it will be seen that as the door 12 is moved between the closed position (shown in solid lines) and the fully opened position (shown in broken lines), viewed from a stationary frame of reference the arm 14 carrying the door sheave 22 rotates 90° around the fixed axis through the floor sheave 20 while the door sheave counterrotates 90° around the axis therethrough in an opposite direction. From the rotating frame of reference of the swinging arm 14, the floor sheave 20 rotates 90° and the door sheave 22 rotates 180° in the same direction. The cable 24 is carried within the moving arm 14, and is fastened to the sheaves 20,22, and is therefore best considered from the rotating frame of reference of the swinging arm 14. From such frame of reference, the length of cable unwound from the circumference of the floor sheave 20 by rotation of the arm 90° therearound must be matched by the length of cable wound onto the circumference of the door sheave 22 during the 180° rotation thereof. The distance around 90° of the circumference of the floor sheave 20 can equal the distance around 180° of the circumference of the door sheave 22 only if the diameter of the floor sheave is twice the diameter of the door sheave, i.e. if the ratio of the circumferences thereof is 2:1.

It is not necessary that the floor sheave 20 or the door sheave 22 be completely circular. The ratio between the floor sheave 20 and the door sheave 22 is determined only with respect to those portions of the circumferences of the sheaves onto which the cable 24 is wound or from which the cable is unwound when the door is opened and closed. Such portions of the circumferences of the sheaves may be termed the effective circumferences thereof. Similarly there may be instances where the ratio of the effective circumferences of the sheaves is not exactly 2:1. When the door moves from the closed position to the opened position, the arm 14 rotates in one direction by an amount about equal to 90° while the door 12 and door sheave 22 carried on the distal end 44 of the arm counterrotate in the opposite direction so that the fully opened door is substantially perpendicular to the doorway and adjacent the pivot jamb 4 of the door frame. If the fixed axis through the floor sheave 20 is spaced medially from the pivot jamb 4 toward the latch jamb 6, the arm 14 must rotate more that 90° around the fixed axis in order to position the door 12 adjacent the pivot jamb. In the moving frame of reference of the swinging arm 14, the floor sheave 20 rotates by the amount of the rotation of the arm around the fixed axis, while the door sheave 22 rotates by an amount 90° greater than the amount of the rotation of the floor sheave. Thus if the arm 14 is to rotate X° around the fixed axis when door 12 is moved between the closed and opened positions, the necessary ratio of the effective circumferences of the sheaves is equal to the ratio of 90 plus X to X alone, or $(90+X):X$. This ratio is less than 2:1 when X is greater than 90°. In general, where the fixed axis through the floor sheave 20 is spaced medially from the pivot jamb 4 toward the latch jamb 6, the ratio between the effective circumferences of the floor sheave and the door sheave will be somewhat less than 2:1.

It will be understood from the foregoing that the function of the cable 24 in coupling the rotation of the door sheave 22 to the rotation of the arm 14 around the fixed axis of the floor sheave 20 may be performed by an endless flexible member encircling and engaging the sheaves 20,22 as well as by a flexible segment fastened to the sheaves. It will be further understood that the sheaves 20,22 may be replaced by toothed wheels of suitable proportion, and the cable 24 replaced by a segmented or endless chain intermeshing with the teeth of said wheels. Similarly, the floor sheave 20 and door sheave 22 may be replaced by interengaging toothed wheels, the intermeshing teeth thereof performing the coupling function of the cable 24 described above. It will also be understood that while the operating mechanism 10 has been described as being positioned immediately between the door and the threshold 2 of the door frame, the operating mechanism may be positioned immediately below the header 8 of the door frame above the door, or may be supported on the pivot jamb intermediately between the threshold and the header, with the door sheave and the distal end of the arm being inset into the body of the pivot side of the door.

The operating mechanism 10 of the present invention includes a substantially conventional coil spring 60 for biasing the door 12 toward a normally closed position. A first end 62 of the spring 60 is fastened to the threshold 2 in a position spaced medially from the floor sheave 20 substantially along the lateral centerline of the door 12 toward the door sheave 22 when the door is in the normally closed position. The opposite second end 64 of the spring 60 is fastened to the underside of the arm plate 34 so that said second end of the spring is spaced medially from the first end 62 of the spring toward the door sheave 22 when the door is in the normally closed position. when the door 12 is opened, the second end 64 of the spring is rotated inwardly with the arm 14, elongating and tensioning the spring so as to bias the door toward the closed position. When the door 12 is released from the opened position, the tensioned spring 60 forces the arm 14 to swing back toward the door frame and rotate around the fixed axis. Such reverse rotation of the arm 14 when the door 12 is being closed reverses the movement of the cable 24 described above—winding the cable onto the floor sheave 20 and counterrotating the door sheave 22 and the door around the axis of the door sheave, and thereby returning the door to the closed position. The segmental nature of the cable 24 positioned below the inner face 52 of the door ensures that the spring 60 does not interfere with the cable. Use of an endless flexible member would cause the portion of such member below the outer face 50 of the door 12 to intersect and contact the spring 60 extending between the first end 62 thereof fastened to the threshold and second end 64 thereof fastened to the swinging arm 14. Although the coil spring 60 is preferred, it will be understood that other means for biasing the door may be used instead.

The operating mechanism 10 is equally useful when the door 12 is to be biased toward a normally opened position. To bias the door toward the opened position, the first end of the spring is fastened to the threshold or floor at a point spaced medially from the floor sheave toward the door sheave and substantially aligned with the centerline of the door when the door is in the opened position (rather than in the closed position coplanar with the opening of the door frame), and the cable extends between the sheaves substantially below the outer face of the door (rather than below the inner face thereof). When the door is moved from the opened position by pulling on a handle on the inner face of the latch side of the door, the arm carrying the second end of the spring swings toward the door frame, elongating the spring and biasing the door toward the desired normally opened position.

The door 12 preferably includes a latch 66 conveniently located in the latch side 18 of the door substantially adjacent the handle 54. The latch 66 retains the door 12 in the closed position by latching the latch side 18 of the door to the latch jamb 6 of the door frame. Balanced doors in general suffer from the drawback that they may be inadvertently opened while latched in the closed position by pushing inwardly on the outer face of the door. The present invention provides a novel safety feature for guarding against inadvertent opening of the door 12 while latched in the closed position. The fixed axis through the floor sheave 20 is offset inwardly from the centerline of the door frame and of the closed door 12. When the door is in the closed position, a line drawn between the latch 66 and the axis of the door sheave 22 and a line drawn from said axis of the door sheave through the fixed axis of the floor sheave 20 form an obtuse angle opening inwardly from the door frame. If the outer face 50 of the door 12 is pushed inwardly while the door is latched closed, the door sheave 22 is translated inwardly so as to flatten said obtuse angle and thus slightly increase the distance between the latch 66 and the fixed axis through the floor sheave 20. The tolerance between the vertical edge of the latch side 18 of the door 12 and the latch jamb 6 of the door frame is suitably small such that the slight movement of said vertical edge toward the latch jamb when the latched door is pushed inwardly causes said vertical edge to become jammed against the latch jamb, preventing further inward movement of the door. The positive latching action produced by the inward offset of the floor sheave 20 from the centerline of the door frame thus prevents inadvertent opening of the door 12 when the door is latched in the closed position.

It will be appreciated that, although specific embodiments of the invention have been described herein for purposes of illustration, various modifications may be made without departing from the spirit and scope of the invention. Accordingly, the scope of the invention is not limited except as by the following claims.

What is claimed is:

1. A balanced door operating mechanism for use with a door disposed within a door frame, the door frame having a side jamb substantially parallel to a selected axis of rotation of the door, said operating mechanism comprising:

(a) a fixed wheel fastenable to the door frame substantially adjacent the side jamb thereof so as to be oriented with the axis of rotation of said fixed wheel parallel to the axis of rotation of the door;

(b) a door wheel fastenable to the door substantially coplanar with the fixed wheel so that the axis of rotation of said door wheel is spaced medially from and oriented parallel to the axis of the fixed wheel;

(c) a substantially rigid arm having a proximal end mounted so as to be pivotable around the axis of rotation of the fixed wheel, and a distal end mounted so as to be pivotable around the axis of rotation of the door wheel, said arm being capable of transferring at least part of the weight of the door to the door frame; and (d) coupling means for rotationally coupling the door wheel and the fixed wheel such that rotation of said door wheel around the axis thereof in a selected direction produces corresponding rotation of the distal end of the arm in the opposite direction around the axis of said fixed wheel in an amount about ninety degrees (90°) less than the amount of rotation of said door wheel.

2. A balanced door operating mechanism according to claim 1, wherein said fixed wheel is fastenable to a threshold of the door frame.

3. A balanced door operating mechanism according to claim 1, wherein said door wheel comprises a door sheave, wherein said fixed wheel comprises a fixed sheave, and wherein said coupling means comprises a substantially inextensible flexible member frictionally engaging and extending between a peripheral portion of said fixed sheave and a peripheral portion of said door sheave, the peripheral portions of said fixed sheave and said door sheave being closer to a selected one of the planar faces of the door than to the other of such faces.

4. A balanced door operating mechanism according to claim 3, wherein said fixed sheave is fastenable to a threshold of the door frame.

5. A balanced door operating mechanism according to claim 3, wherein the ratio of the effective circumference of the fixed sheave to the effective circumference of the door sheave is about 2:1.

6. A balanced door operating mechanism according to claim 3, wherein the flexible member comprises opposite ends respectively fastened to the fixed sheave and to the door sheave.

7. A balanced door operating mechanism according to claim 1, further including means for biasing the door toward a normal position.

8. A balanced door operating mechanism according to claim 7, wherein the normal position of the door is the closed position,

9. A balanced door operating mechanism according to claim 1, wherein the arm substantially encloses the door wheel, the fixed wheel and the coupling means.

10. A balanced door assembly for use within a door frame, comprising:

(a) a door disposed for rotation within the door frame around an axis of rotation substantially parallel to a side jamb of the door frame;

(b) a fixed wheel fastenable to the door frame substantially adjacent the side jamb thereof so that the axis of rotation of said fixed wheel is oriented parallel to the axis of rotation of the door;

(c) a door wheel fastened to the door substantially coplanar with the fixed wheel, said door wheel oriented with the axis of rotation thereof being spaced medially from and oriented parallel to the axis of the fixed wheel;

(d) a substantially rigid arm having a proximal end mounted so as to be pivotable around the axis of rotation of the fixed wheel, and a distal end mounted so as to be pivotable around the axis of rotation of the door wheel, said arm being capable of transferring at least part of the weight of the door to the door frame; and (e) coupling means for rotationally coupling the door wheel and the fixed wheel such that rotation of said door wheel around the axis thereof in a selected direction produces corresponding rotation of the distal end of the arm in the opposite direction around the axis of said fixed wheel in an amount about ninety degrees (90°) less than the amount of rotation of said door wheel.

11. A balanced door assembly according to claim 10, wherein said fixed wheel comprises a floor sheave fastenable to a threshold of the door frame, wherein the door wheel comprises a door sheave, the ratio of the effective circumference of said floor sheave to the effective circumference of said door sheave being about 2:1, and wherein said coupling means comprises a substantially inextensible flexible member frictionally engaging and extending between a peripheral portion of said floor sheave and a peripheral portion of said door sheave, the peripheral portions of said floor sheave and said door sheave being closer to a selected one of the planar faces of the door than to the other of such faces.

12. A balanced door assembly according to claim 10, further including means for biasing the door toward a normally closed position.

13. A balanced door operating mechanism according to claim 10, wherein the arm substantially encloses the door wheel, the fixed wheel and the coupling means.

* * * * *